US006394852B1

(12) United States Patent
Huang

(10) Patent No.: US 6,394,852 B1
(45) Date of Patent: May 28, 2002

(54) MULTICHANNEL PHONE PLUG

(76) Inventor: Jui-Shu Huang, No.2, Hung Chang 11th Street, Taoyuan City (TW)

( * ) Notice: Subject to any disclaimer, the term of this patent is extended or adjusted under 35 U.S.C. 154(b) by 0 days.

(21) Appl. No.: 09/985,199

(22) Filed: Nov. 2, 2001

(51) Int. Cl.[7] ..... H01R 24/04
(52) U.S. Cl. ..... 439/669; 439/668
(58) Field of Search ..... 439/669, 668, 439/23, 24, 21

(56) References Cited

U.S. PATENT DOCUMENTS 604,094 A * 5/1898 Taylor ..... 439/669
1,841,468 A * 1/1932 Ford ..... 439/669
2,499,474 A * 3/1950 Engqvist ..... 439/669
3,289,149 A * 11/1966 Pawloski ..... 439/669
4,018,501 A * 4/1977 Maloof ..... 439/669
4,158,472 A * 6/1979 Seiden et al. ..... 439/502
5,820,416 A * 10/1998 Carmichael ..... 439/668

* cited by examiner

*Primary Examiner*—Tho D. Ta
*Assistant Examiner*—Ross Gushi
(74) *Attorney, Agent, or Firm*—Rosenberg, Klein & Lee

(57) ABSTRACT

The present invention relates to a multichannel phone plug which is constructed as a shaftlike male terminal at the front part thereof and is pluggable in a phone jack for an electric connection. The male terminal contains six or seven pole sockets which are combined in a body by insertion from the front to the rear. An insulting piece is mounted between every two pole sockets. Each of the pole sockets is connected to a sound signal cable at the end thereof, respectively. A handle whose diameter is greater than that of the male terminal is fitted to the end of the male terminal. The sound signal cable in connection with the sockets extends from the end of the handle for a certain length in order that the end thereof is connected to a multichannel speaker. Accordingly, the multichannel phone plug in accordance with the present invention is convenient in use, and one single plug can transmit five or six sound signals.

4 Claims, 11 Drawing Sheets

| Contour dimension | | | | | | | | | |
|---|---|---|---|---|---|---|---|---|---|
| Mark | Diameter 6.35mm | | | | Mark | Diameter 6.35mm | | | |
| | mm | | inch | | | mm | | inch | |
| | max | min | max | min | | max | min | max | min |
| A | 6.32 | 6.27 | .249 | .247 | F | 11.73 | 11.27 | .462 | .444 |
| B | 30.61 | 29.77 | 1.205 | 1.172 | G | 8.16 | 7.84 | .321 | .309 |
| C | 25.27 | 24.76 | .995 | .975 | H | 4.59 | 4.41 | .180 | .174 |
| D | 21.72 | 21.34 | .855 | .840 | I | 6.32 | 6.10 | .249 | .240 |
| E | 15.37 | 14.48 | .605 | .570 | K | 50° | 40° | 50° | 40° |

FIG. 11

MULTICHANNEL PHONE PLUG

BACKGROUND OF THE INVENTION

1. Field of the Invention

The present invention relates to a multichannel phone plug, and more particularly, to a single phone plug which transmits five or six sound signals and has the multichannel function, or the like.

2. Description of the Prior Art

A so-called phone plug, shown in FIG. 1, is constructed as a shaftlike terminal (a) being pluggable into a phone jack of the analog signal output for an electric connection. The sound signals are transmitted through a sound signal cable to a speaker or the commercially available earphone. Thus, the phone plug (a) has the convenience in operation and in use regarding the connection of sound signals.

However, the commercially available phone plug (a) has only few electric poles and can only transmit at most two sound signals, that is, the left and right sound channels and the earth terminal, thereby forming a stereophonic effect. Consequently, the current headphones can only reach two channel sound effect.

With the improvement of the digital technology and the popularization of the digital audio-video products like DVD players or surround amplifiers, they basically own the Dolby Digital and DTS decoding functions through which the digital signals are decoded to output the analog signals to the speaker. Therefore, DVD players or the surround amplifiers include an analog output terminal of 5.1-ch sound signals for establishing a home theater system with TV, DVD player, surround amplifier and 5.1-ch speaker.

In order to reach the multichannel sound effect, several output terminals and sound signal cables have to be used for connection with the front, the center and the rear surround channels or the woofer. Accordingly, the AUDIO OUT terminal on the rear panel of the DVD player or the surround amplifier is connected with over six plugs and sound signal cables in order to transmit the sound signals to each of the speakers, thereby causing the cable clutter on the rear panel and, therefore, leading to much inconvenience.

5.1-ch or multichannel sound output brings the listeners an excellent enjoyment of the best sound effect. However, this will trouble the one who is at work and doesn't listen to the sound. When putting on headphone, the listeners can't enjoy the multichannel surround sound effect since the phone plug (a) can only reach the right and left (two) channel stereophonic effect.

Currently, the 5.1-ch headphone is commercially available. However, this kind of product only simulates the 5.1 decoding function rather than the reproduction of the 5.1-ch original sound. In addition, a negative effect will be produced when the simulated sound is not processed well.

Since the headphone is considered as attachments rather than the core of the stereo set and the profit thereof is low, only few want to invest in this field for further development. Therefore, the currently existing headphone gives only two channel original sound. The reason is that the conventional phone plug has only two or three electric poles (one of them is for earthing) so that the single plug can't transmit multichannel sound signal.

Another conventional multipole plug (TW 294851, see Attachment 1), disclosed by a Japanese firm, is shown in FIG. 2. In order to improve the conventional multipole plug shown in FIG. 1, this multipole plug has a pin-shaped electric pole (b) and a plurality of concentric cylinders (c), thereby forming a multiple socket poles. The volume of this kind of plug is greater than the conventional phone plug (a) and this plug doesn't fit in the common phone jacks. Accordingly, its application is much limited so that it's not practical as a phone plug.

A further conventional multipole plug, as shown in FIGS. 3 and 4, includes a shaftlike plug (d) with a plurality of conductive poles and several conductive prongs (e) which are formed in a body by injection-molding process. However, this kind of plug is too complicate and large in volume so that it's also not practical as a phone plug.

Since the phone plug and the phone jack had been widely used, four standard diameters (6.35 mm, 5.33 mm, 3.56 mm and 2.54 mm) thereof: was developed. The smaller diameters (3.56 mm and 2.54 mm) are mostly applicable to the Walkman or the bedside stereo sets while the greater diameters (6.35 mm, 5.33 mm) are mostly applicable to the professional stereo sets. Therefore, any plugs which deviate from the above four standard diameters can't be accepted by the market so that such plugs don't meet the requirement of practicalness.

Another reason why the further development of the multichannel phone plug was not valued lies in that safety standards for the phone plug and the phone jack are regulated in many countries. The phone plug and the phone jack can be loaded with up to the current and the voltage in the following table while the insulating part can't have the flashover or any destroying phenomena.

Max. loadable value of voltage and current for the dielectric

| Diameter of sockets or plugs (mm) | 6.35 | 5.33 | 3.56 | 2.54 |
|---|---|---|---|---|
| Max nominal voltage (60 Hz) at rms current | 500 V | 500 V | 250 V | 250 V |
| Nominal current | 1 Amp. | 1 Amp. | 2 Amp. | 2 Amp. |

It is still not attainable by the current technology that at least six electric poles are formed on the above plugs with four different diameters. Moreover, the insulating piece has to meet the above-mentioned requirements. Furthermore, the sound signals transmitted by each of the electric poles can't be disturbed by one another in order to keep the sound effect.

SUMMARY OF THE INVENTION

It is a primary object of the present invention to remove the above-mentioned drawbacks and to provide a multichannel phone plug whose different diameters meet the standard regulated in every country in the world while six or seven electric poles are mounted on the surface of the single shaftlike terminal for transmitting five or six sound signals. Therefore, it is practical in use and can be widely accepted.

It is another object of the present invention to provide a multichannel phone plug which is particularly applicable to the headphones through which the multichannel sound effect produced by the DVD player or surround amplifier can be heard.

It is a further object of the present invention to provide a multichannel phone plug which can replace the conventional audio output with a plurality of terminals in order to simplify the configuration of the terminal.

It is still another object of the present invention to provide a multichannel phone plug which is applicable to the headphone for the international conference, and the user can receive multichannel sound signals at the same time.

BRIEF DESCRIPTION OF THE DRAWINGS

The accomplishment of this and other objects of the invention will become apparent from the following description and its accompanying drawings of which:

FIG. 11 is a contour dimension table of FIG. 10;

DETAILED DESCRIPTION OF THE PREFERRED EMBODIMENT

Figure 1:
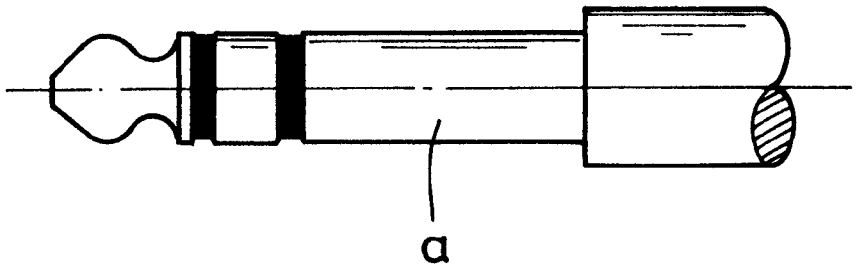
FIG.1 PRIOR ART
FIG. 1 is a schematic drawing of a conventional phone plug.
Figure 2:
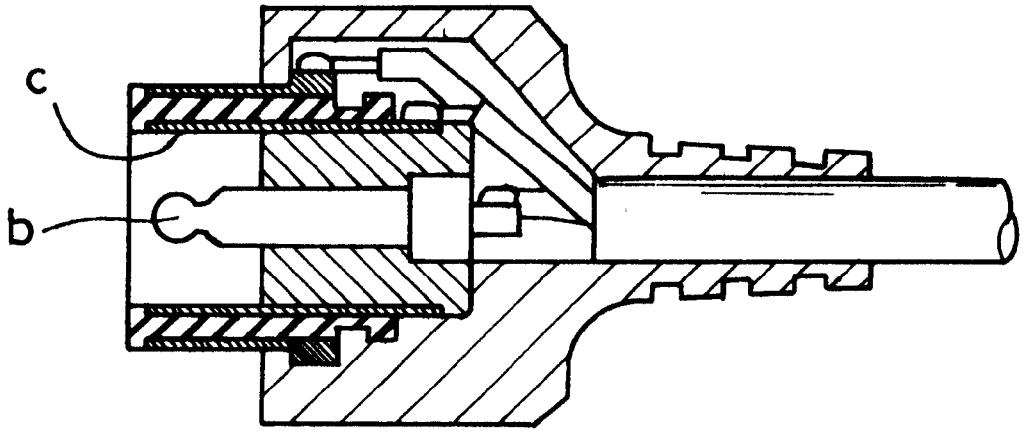
FIG.2 PRIOR ART
FIG. 2 is a schematic drawing of another conventional multipole plug.
Figure 3:
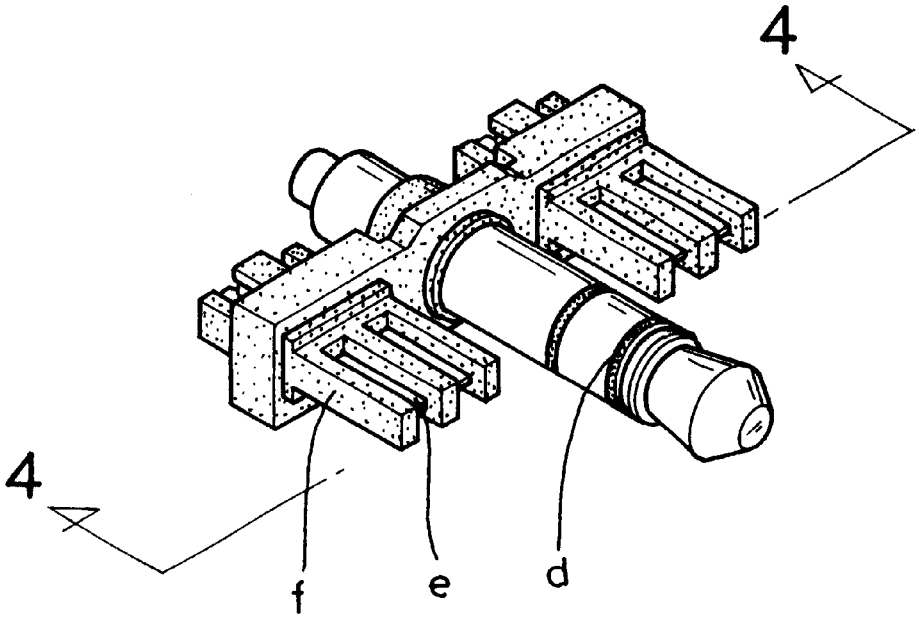
FIG.3 PRIOR ART
FIG. 3 is a perspective view of a further conventional multipole plug.
Figure 4:
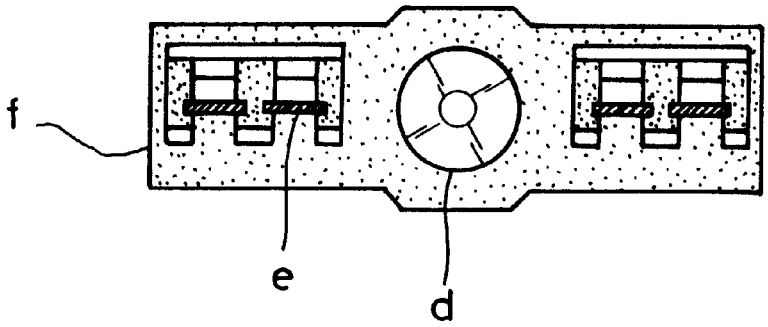
FIG.4 PRIOR ART
FIG. 4 is a front view of the conventional multipole plug of FIG. 3.
Figure 5:
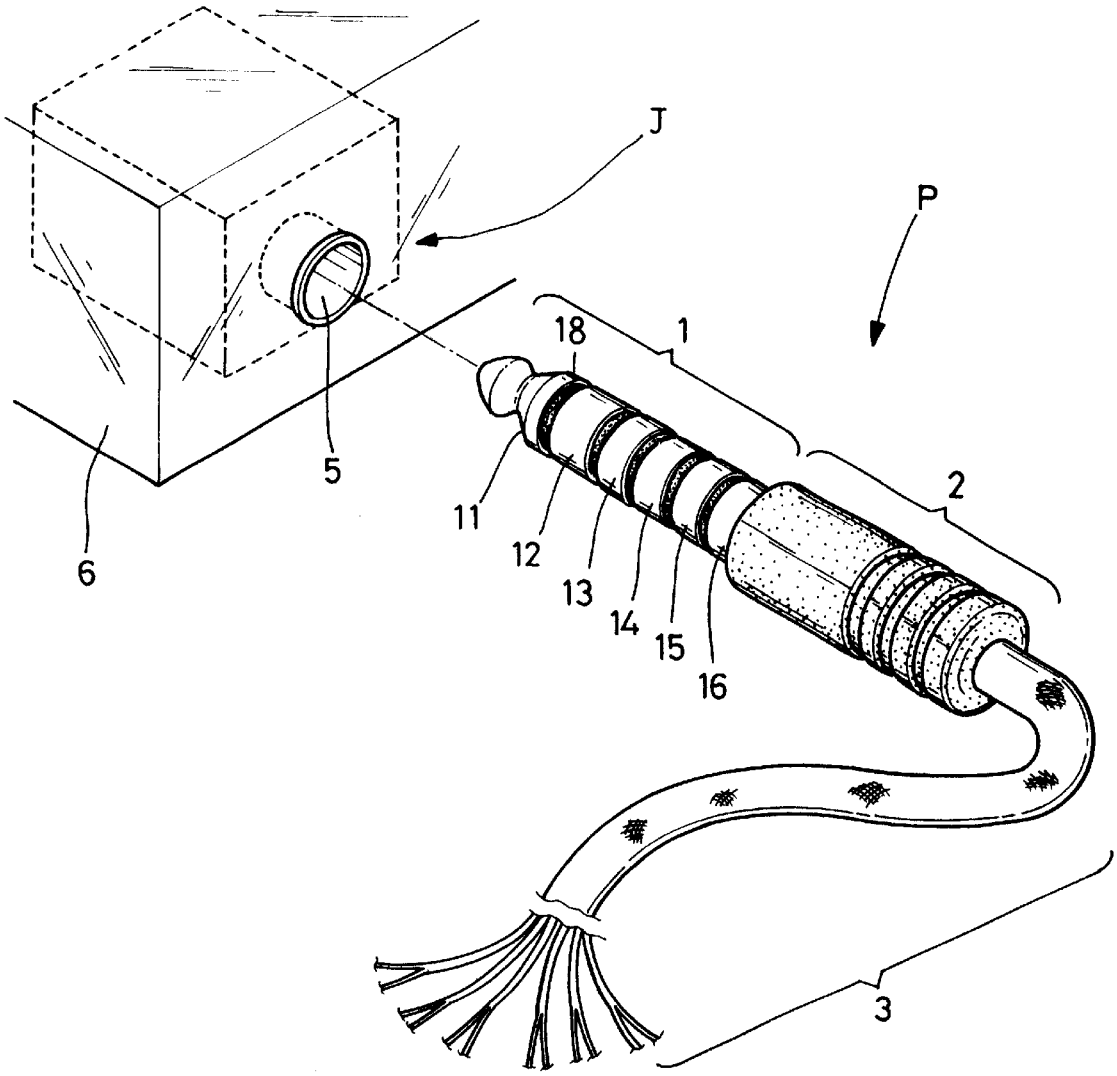
FIG. 5 is a perspective view of a first embodiment of the present invention.
Figure 6:
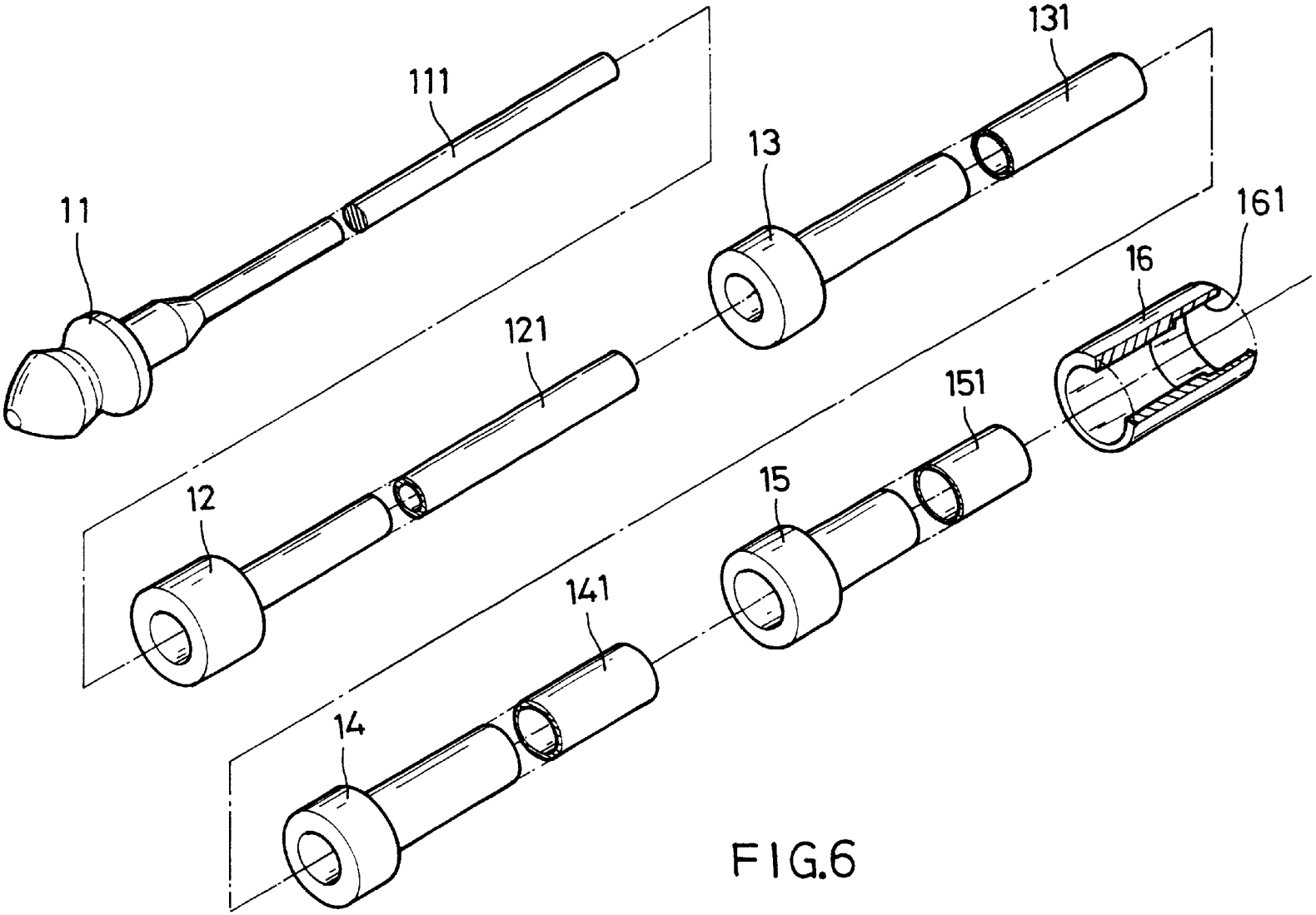
FIG. 6 is an exploded view of pole sockets of the terminal of the present invention.
Figure 8:
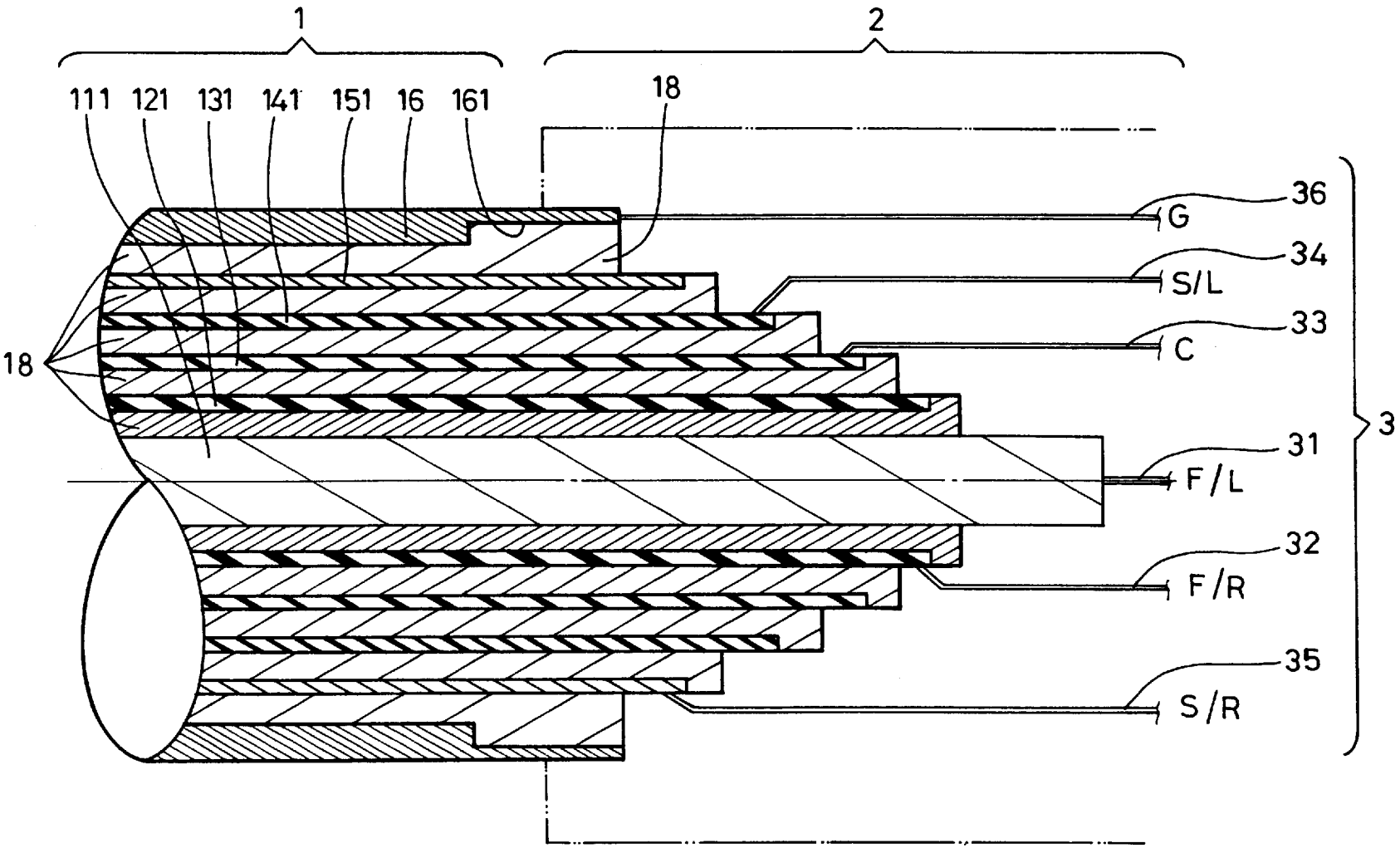
FIG. 8 is a partial enlarged view of FIG. 7.

First of all, referring to FIGS. 5 and 8, a first embodiment of the present invention is shown. The front part of the phone plug (P) is constructed as a shaftlike male terminal 1 which is pluggable in a phone jack (J) for an electric connection. The male terminal 1 of the phone plug (P) consists of six concentric pole sockets 11–16 whose length is decreasing from the front to the rear and which are combined in a body. The pole sockets 11–16, as illustrated in FIG. 6, contains a tapered head 11 at the front end, an enclosing ring 16 at the rear end thereof and four middle sockets 12–15 therebetween. The tapered head 11 has an extension bar 111 which is the longest and thinnest and can be inserted in an extension member 121 of the first socket 12. The extension member 121 of the first socket 12 can be inserted into an extension member 131 of the second socket 13. The extension member 131 of the second socket 13 can be inserted into an extension member 141 of the third socket 14. The extension member 141 of the third socket 14 can be inserted into an extension member 151 of the fourth socket 15. The extension member 151 of the fourth socket 15 can be inserted into the enclosing ring 16.

A prearranged clearance has to be reserved after insertion of each of the pole sockets 11–16, and an insulting piece 18 is mounted around each of the clearances. Each of the pole sockets 11–16 is connected with a sound signal cable 3 at the end thereof, and a handle 2 with a larger diameter than that of the male terminal 1 is disposed at the end of the male terminal 1.

The sound signal cable 3 connected with the pole sockets 11–16 extends from the end of the handle 2 for a certain length in order that the end thereof is connected to a multichannel speaker 4.

The pole sockets 11–16, as shown in FIG. 6, have the same external diameter, and the diameter of the extension bar 111 and the extension members 121, 131, 141, 151 increases one after the other while the length thereof decreases in the same sequence. Accordingly, concentric clearances are reserved for arrangement of the insulting pieces 18 and they all are combined in a body, thereby forming a complete surface of the male terminal 1 and six different separate contact poles. It's preferable that the extension bar 111 is constructed as a solid body in order that the mechanic strength of the male terminal 1 is strengthened; however, the extension members 121, 131, 141, 151 are constructed as tube body, or the like.

Figure 7:
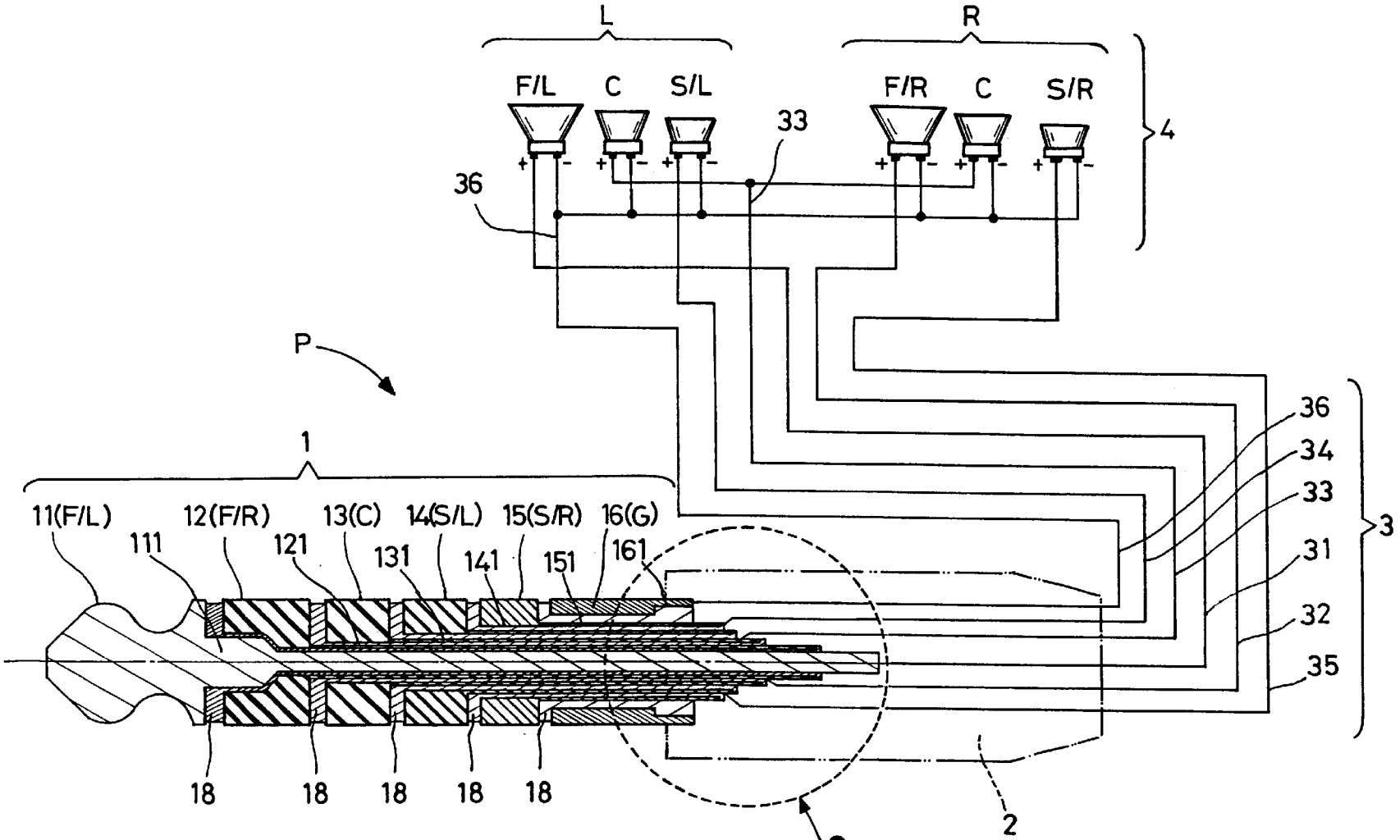
FIG. 7 is a longitudinally sectional view of the pole sockets of the present invention in connection with respective signal wires.

FIG. 8 shows a partially enlarged view of the FIG. 7. The insulting pieces 18 can't be too thin because they have to meet the requirements of the electric strength standard for prevention of the flashover or other destroying phenomena. However, the extension bar 111 and the extension members 121, 131, 141, 151 of the pole sockets 11–16 can't be too thick since it will be no room for arrangement of the insulting pieces 18 with a proper thickness. In addition, a space has to be reserved at the end thereof for connection of each wire of the sound signal cable 3. Furthermore, the rearmost earthing ring 16 has an extension member 161 whose internal diameter is enlarged so that the insulting piece 18 forms an obstruction to stabilize the structure of the inserted pole sockets 11–16.

Again, referring to FIGS. 7 and 8, the tapered head 11 at the front end of the male terminal 1 serves as a sound signal pole for the front left sound channel (F/L), and the extension bar 111 is in connection with the first wire 31. The first socket 12 of the four middle sockets serves as sound signal pole for the front right sound channel (F/R), and the extension member 121 is in connection with the second wire 32. The second socket 13 serves as the sound signal pole for the central sound channel (C), and the extension member 131 is in connection with the third wire 33. The third socket 14 serves as the sound signal pole for the rear surrounding left sound channel (S/L), and the extension bar 141 is in connection with the fourth wire 34. The fourth socket 15 serves as sound signal pole for the rear surrounding right sound channel (S/R), and the extension member 151 is in connection with the fifth wire 35. The enclosing ring 16 at the rear end of the male terminal 1 is the earth terminal, and its extension member 161 is in connection with the sixth wire 36.

The first through fifth wires 31–35 are connected with the sixth wire 36 of the earth terminal, thereby forming multiple sound signal cable 3 of the positive and negative poles, and the terminals can be connected to the different sound channels of the multichannel speaker 4, respectively. Besides, the third wire 33 is divided into two wires at the end thereof which are then connected to the sixth wire 36 of the earth terminal and serve as sound signal lead of two speakers of the central sound channel (C).

Figure 9:
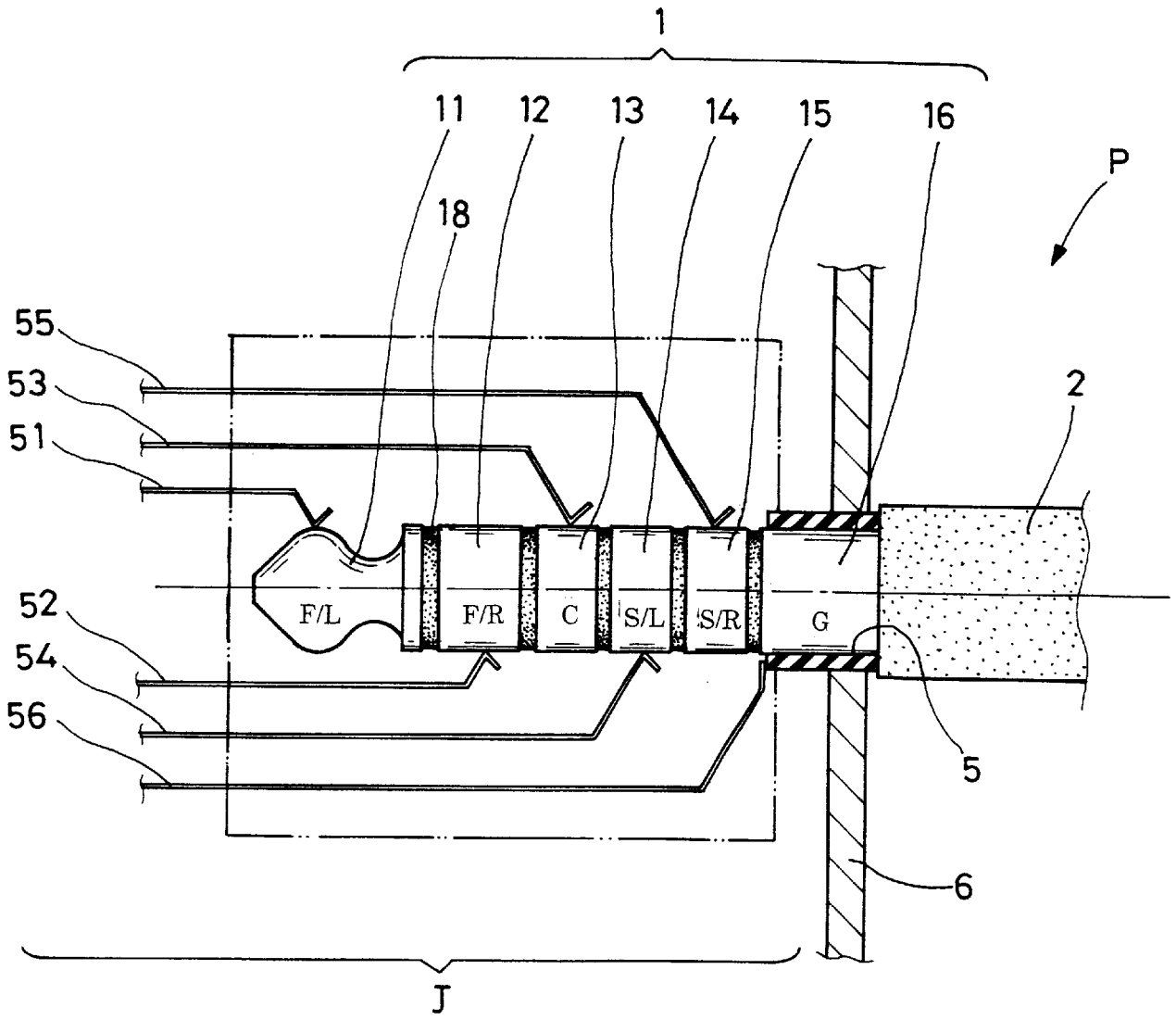
FIG. 9 is a schematic drawing of the present invention in connection with a phone jack.

FIG. 9 shows a schematic drawing of the connection of the phone plug (P) of the present invention in the phone jack (J). Based on the above-mentioned, the surface of the male terminal 1 is provided with six separate pole sockets 11–16 of different sound signals while the phone jack (J) inside the stereo set 6 has contact springs 51–56 corresponding to each of the pole sockets 11–16, respectively. Therefore, the multichannel sound circuit can be transmitted through the contact springs 51–56 to the pole sockets 11–16 of the male terminal 1. The sixth contact spring 56 is in connection with the outermost socket ring 5 which is connected to the enclosing ring 16 of the phone plug (P). Accordingly, the phone jack (J) is designed in accordance with the six electric poles of the phone plug (P). Basically, when the phone plug (P) has six or seven electric poles, the phone jack (J) is correspondingly designed. No further descriptions in respect thereof will be given hereinafter.

Figure 10:
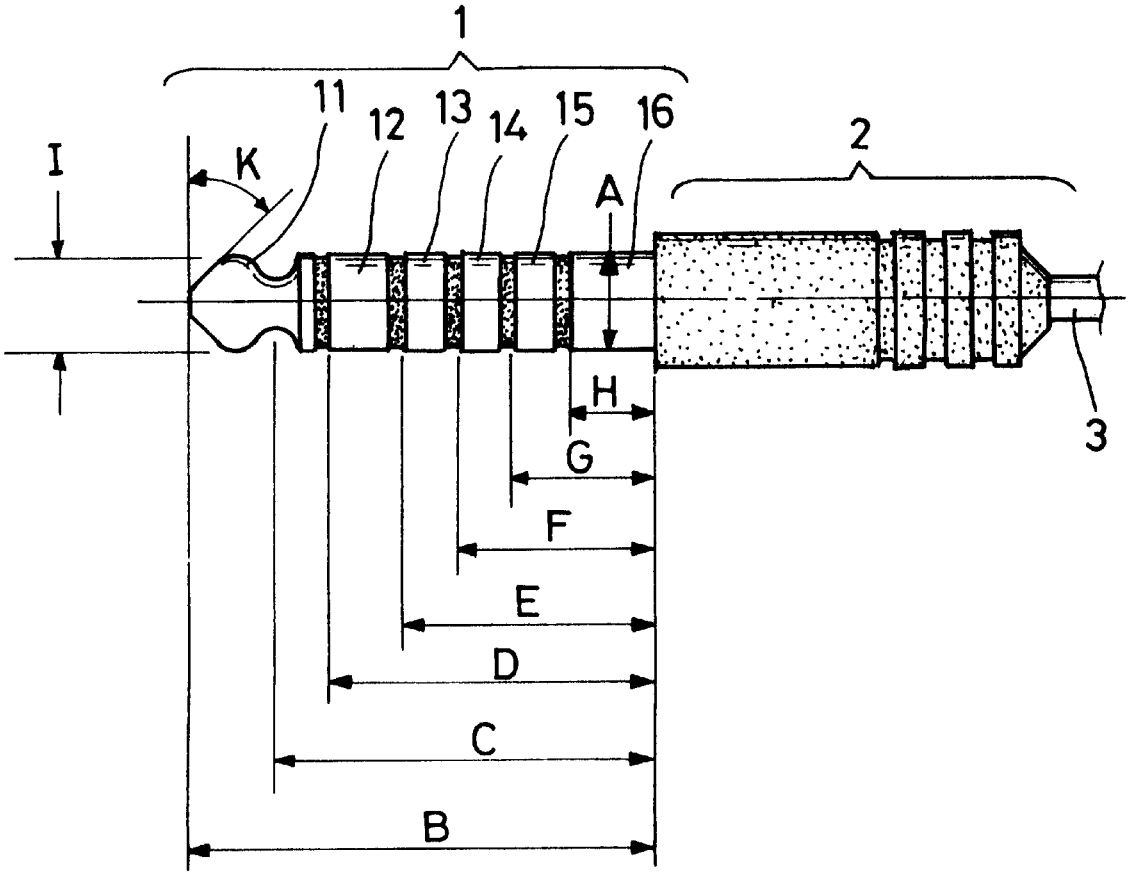
FIG. 10 is a schematic drawing of the present invention, showing the contour dimension of different parts.

FIG. 10 illustrates a schematic drawing of the present invention, showing the dimension of different parts while FIG. 11 shows a dimension table of FIG. 10. It's apparent from both figures that the length of the male terminal 1 is identical with the length of the conventional double-pole plug when the diameter of the plug of the present invention amounts to 6.35 mm. Accordingly, the phone plug (P) can be inserted into any of the commercially available phone jacks. If the phone jack has only two sound channels, the multichannel phone plug of the present invention can also be used. The position of the tapered head 11 and the first socket 12 are arranged in such a way that they can be in contact with the contact springs (not shown) of the conventional two-channel plug (11) for output of the right and left channels. Accordingly, the phone plug (P) disclosed by the present invention is also suitable for the conventional phone jack. In addition to the diameter of 6.55 mm, the diameter of the multichannel phone plug of the present invention can be 5.33 mm, 3.56 mm or 2.54 mm.

Figure 12:
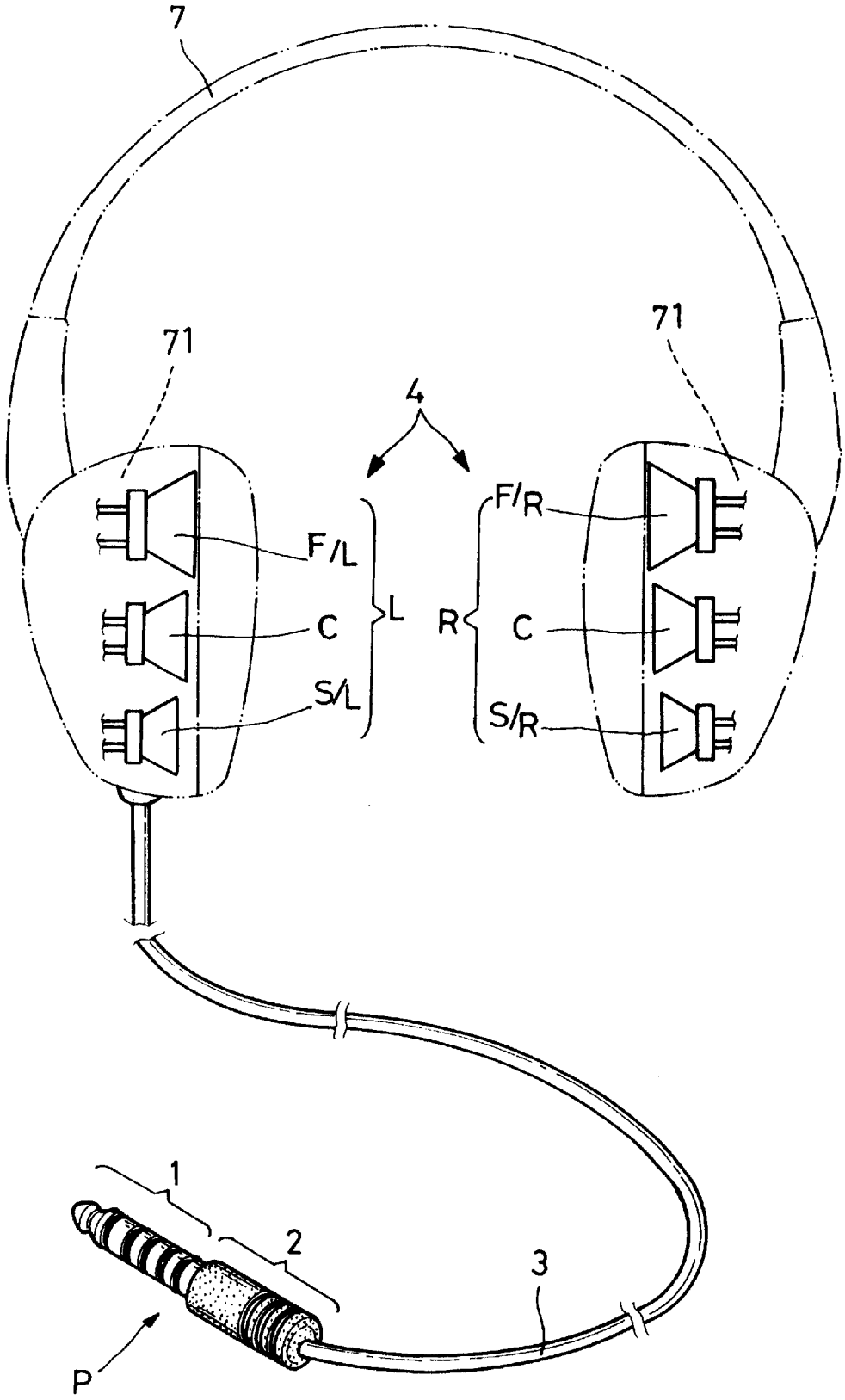
FIG. 12 is a schematic drawing of the present invention in connection with a headphone.

FIG. 12 shows a schematic drawing of the multichannel phone plug of the present invention applied to the headphone 7. The multichannel phone plug (P) consists of the male terminal 1 and the handle 2, and the male terminal 1 includes six pole sockets which are inserted in one another. The multichannel analog signal is transmitted through the sound signal cable 3 to the ear retainers 71 at two sides of the headphone 7. A plurality of speakers 4 are disposed inside the ear retainers 71 each of which is provided with the front left and right speakers (F/L, F/R), the central speaker (C) and the rear surrounding left and right speakers (S/L, S/R). When the listener puts on the headphone 7, the heard multichannel sound is an original sound rather than the simulated sound. Therefore, an excellent tone quality is achieved.

Certainly, the multichannel phone plug (P) of the present invention is not restricted to the application to the headphone of the conventional stereo sets, it is also applicable to the home theater, the passenger seats on the airplane and the meeting rooms. A multichannel transmission is attainable by means of the connection of the phone plug (P) and the phone jack (J) so that the sound signal channels is optional. This is particularly practical for the international conference with the translation of different languages.

Figure 13:
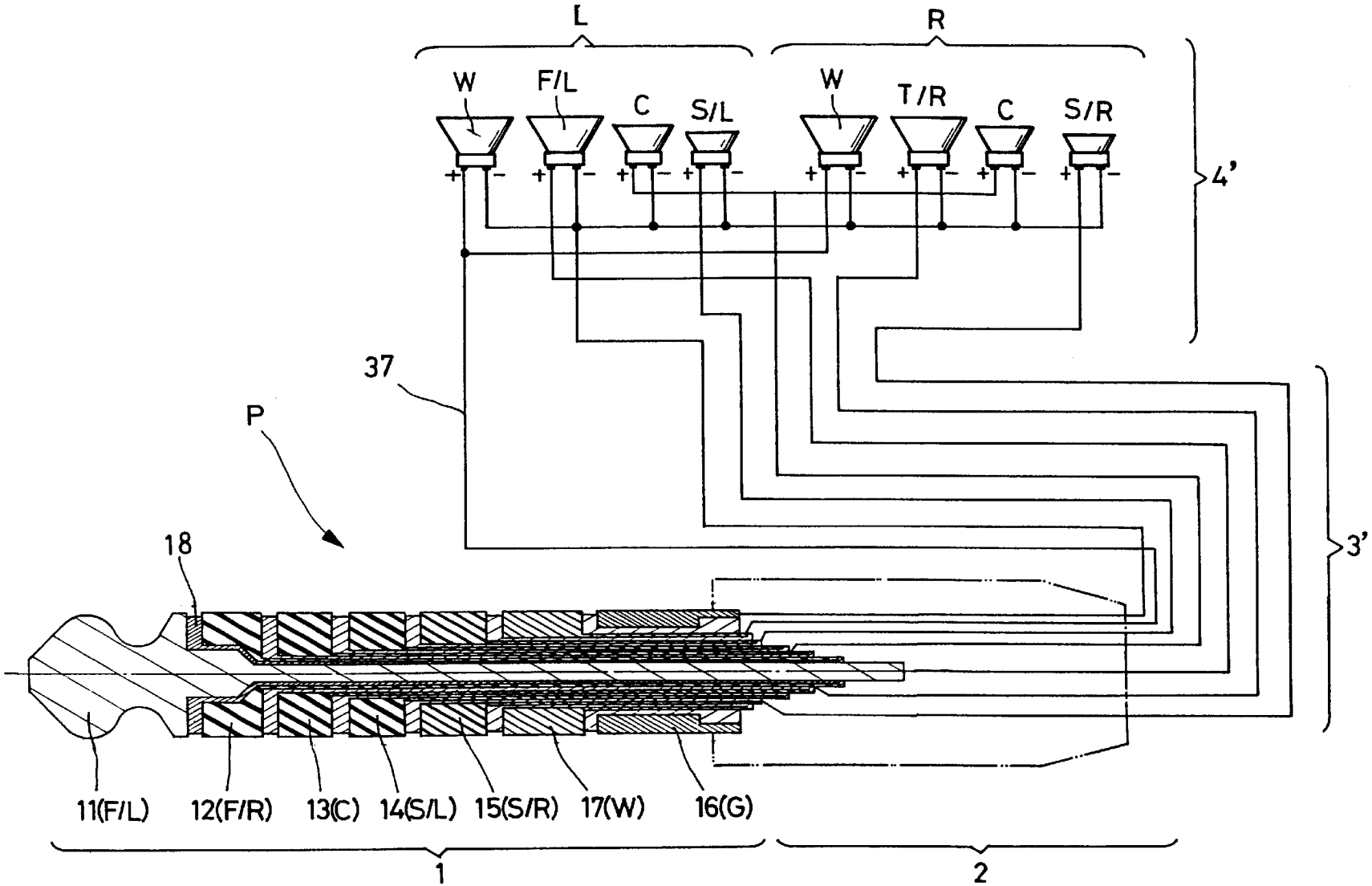
FIG. 13 is a longitudinally sectional view of a second embodiment of the present invention.

FIG. 13 shows a longitudinally sectional view of a second embodiment of the present invention. In this embodiment, seven rather than six pole sockets are provided. A further fifth socket 17 is added to the middle four sockets, and the others are not changed. The additional fifth socket 17 is used for output of the special sound signal like low-frequency sounds. A seventh wire 37 connected to the end of the fifth socket 17 can be in connection with a woofer (W). The sound signal cable 3' has a more sound signal wire than the sound signal cable 3 so that a further sound channel is added to the multichannel speaker 4' to meet the requirement of special sound effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A multichannel phone plug comprising a male terminal pluggable in a phone jack;

wherein the improvement is characterized by:

said male terminal having six or seven concentric pole sockets whose length is decreasing and whose diameter is increasing from the front to the rear, all of which being combined by insertion in a body;

a prearranged clearance reserved after insertion of each of said pole sockets, an insulting piece being mounted around each of the clearances for separating every two pole sockets, each of said pole sockets being connected with a sound signal cable at the end thereof, a handle with a larger diameter than that of said male terminal being disposed at the end of said male terminal; and said sound signal cable in connection with said sockets extending from the end of said handle for a certain length in order that the end thereof is connected to a multichannel speaker.

2. The multichannel phone plug as recited in claim 1 wherein six pole sockets contains a tapered head at the front end, an enclosing ring at the rear end thereof and four middle sockets therebetween, and wherein said tapered head has an extension bar which is the longest and thinnest and can be inserted in an extension member of a first socket, and wherein said extension member of said first socket can be inserted into an extension member of a second socket, and wherein said extension member of said second socket can be inserted into an extension member of a third socket, and wherein said extension member of said third socket can be inserted into an extension member of a fourth socket, and wherein said extension member of said fourth socket can be inserted into the enclosing ring.

3. The multichannel phone plug as recited in claim 1 wherein seven pole sockets contains a tapered head at the front end, an enclosing ring at the rear end thereof and five middle sockets therebetween, and wherein said tapered head has an extension bar which is the longest and thinnest and can be inserted in an extension member of a first socket, and wherein said extension member of said first socket can be inserted into an extension member of a second socket, and wherein said extension member of said second socket can be inserted into an extension member of a third socket, and wherein said extension member of said third socket can be inserted into an extension member of a fourth socket, and wherein said extension member of said fourth socket can be inserted into an extension member of a fifth socket, and wherein said extension member of said fifth socket can be inserted into the enclosing ring.

4. The multichannel phone plug as recited in claim 1 wherein said phone jack in which said phone plug is inserted has contact springs corresponding to each of said pole sockets.

* * * * *